US006351435B1

(12) United States Patent
Kronenberg et al.

(10) Patent No.: US 6,351,435 B1
(45) Date of Patent: Feb. 26, 2002

(54) DISPLAY HAVING AT LEAST ONE HAND, IN PARTICULAR FOR TIMEPIECES

(75) Inventors: Klaus Kronenberg, Sulzbach; Walter Rüb; Peter Schäfer, both of Frankfurt; Erwin Sedlaczek, Steinbach; Mike Theis, Gross-Umstadt, all of (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/470,181

(22) Filed: Dec. 22, 1999

(30) Foreign Application Priority Data

Dec. 24, 1998 (DE) ..... 198 60 266

(51) Int. Cl.[7] ..... G04F 10/00
(52) U.S. Cl. ..... 368/112
(58) Field of Search ..... 368/107–113

(56) References Cited

U.S. PATENT DOCUMENTS 1,989,584 A * 1/1935 Biedenfeld ..... 368/238
3,696,609 A * 10/1972 Dubois ..... 368/220
3,701,250 A * 10/1972 Ono ..... 368/108
4,050,234 A * 9/1977 Toshio ..... 368/108

FOREIGN PATENT DOCUMENTS

| | | |
|---|---|---|
| DE | 1448997 | 6/1969 |
| DE | 4010781 | 10/1991 |
| DE | 4029308 | 3/1992 |

* cited by examiner

*Primary Examiner*—Bernard Roskoski
(74) *Attorney, Agent, or Firm*—Martin A. Farber

(57) ABSTRACT

A display having at least one hand which can be driven by an electric drive, it being possible for the hand or the hands to execute rotations of more than 360° in a first direction, wherein it is provided that the hand or the hands (Z) can be rotated in a second direction (CCW) which is counter to the first direction (CW), that the hand or one of the hands (Z) can be rotated in the second direction(CCW) only up to a certain position (P) and, in this position, assumes a reference position, and that there is a detecting device (V) which detects the inability of the hand (Z) to rotate further in the second direction (CCW).

14 Claims, 4 Drawing Sheets

DISPLAY HAVING AT LEAST ONE HAND, IN PARTICULAR FOR TIMEPIECES

FIELD AND BACKGROUND OF THE INVENTION

The invention relates to a display having at least one hand which can be driven by an electric drive, it being possible for the hand or the hands to execute rotations of more than 360° in a first direction.

The prior art discloses, for example, displays of radio-controlled timepieces having a plurality of hands. These radio-controlled timepieces are controlled centrally via a longwave transmitter. If the reception of the long waves in the timepieces is disrupted, or following a battery change in such a timepiece, synchronization of the dial train is necessary. For this purpose, it is known to arrange, in gear wheels of the gear stages of the timepiece, perforated masks in the form of holes or through-passages in a defined form in the gear wheels, it being possible for these to be decoded by an optical sensor and thus likewise for the positions of the hands to be decoded.

The disadvantages here are the high tolerance requirements which have to be met for producing the perforated masks, small tolerances in assembly by the divergence of the production sizes, and necessary positioning accuracy of the optical sensors.

SUMMARY OF THE INVENTION

The object of the invention is thus to provide a display having at least one hand in the case of which, for at least one of the hands, a defined reference position can be detected without an optical sensor and the tolerance-related requirements can be lower.

These objects are achieved in that the hand or the hands can be rotated in a second direction which is counter to the first direction, in that the hand or one of the hands can be rotated in the second direction only up to a certain position and, in this certain position, assumes a reference position, and in that there is a detecting device which detects the inability to rotate further in the second direction.

In a particularly straightforward manner, the hand or one of the hands can be prevented from rotating further beyond a certain reference point in a second direction by a stopping device.

A straightforward configuration of the stopping device can be realized in that one or more locking bars are mounted such that they allow unlimited rotation in the first direction similar to a freewheeling hub, for example, of a bicycle and interact with a stop upon rotation in the second direction and thus prevent further rotation of the hand or of the hands.

In an even more straightforward and inexpensive manner, the stop device can be realized in that it has one or more segments which interact in each case with a stop, it being the case that the segment or the segments or the stop or the stops is/are mounted such that they can be rotated about an axis of rotation and the segments have slanting surfaces which, upon rotation of the hand in the first direction cause an axial displacement of the segment or of the segments or of the stop or of the stops such that the rotation can be continued in an unlimited manner, and it being the case that, upon rotation in the second direction, the segment or the segments strikes or strike in a certain position against the stop or the stops and thus rules or rule out further rotation in the second direction, and the hand is connected in a rotationally fixed manner to the segment or the segments or the stop or the stops.

A plurality of segments at different distances from the axis of rotation achieve the situation where each segment can only interact with a certain stop and can thus assume a reference position during rotation. Due to the plurality of such segments which are arranged around the axis of rotation, canting of the components is ruled out by the axial movement of the segment and stop with respect to one another, by the uniform development of force of all the slanting surfaces of the segments.

The arrangement of a plurality of segments can be realized particularly favorably on a first disk, it being possible for the component to be configured as a single-piece injection molding from segments and disks. It is likewise possible for the stops to be arranged particularly favorably on a second disk.

Installation is particularly straightforward if one of the two disks is configured as part of a housing of the display or of the drive thereof. A detecting device which detects the inability of the hand to rotate further in the second direction can be realized via monitoring of the power consumption of the electric drive. As soon as the hand has reached its reference position, upon rotation of the hand in the second direction, and cannot move any further in the second direction, the power consumption of the still switched-on electric drive increases considerably, with the result that, by monitoring the power consumption, it is possible to infer, for a considerably increased value, that the reference position has been reached.

If the electric drive has a permanent-magnet rotor and a plurality of coils which are supplied with power one after the other, for example, in the manner of a stepping motor and thus move the permanent-magnet rotor further, it is possible, by monitoring the voltages which the permanent-magnet rotor induces, by its movement, in a coil which has not been supplied with power, to infer the rotation of the rotor. Accordingly, if it is no longer possible to establish any induced voltage, it is thus detected that the hand has assumed its reference position.

BRIEF DESCRIPTION OF THE DRAWINGS

The invention is explained in more detail hereinbelow with reference to the figures of the drawings, in which.

DETAILED DESCRIPTION OF THE PREFERRED EMBODIMENT

Figure 1:
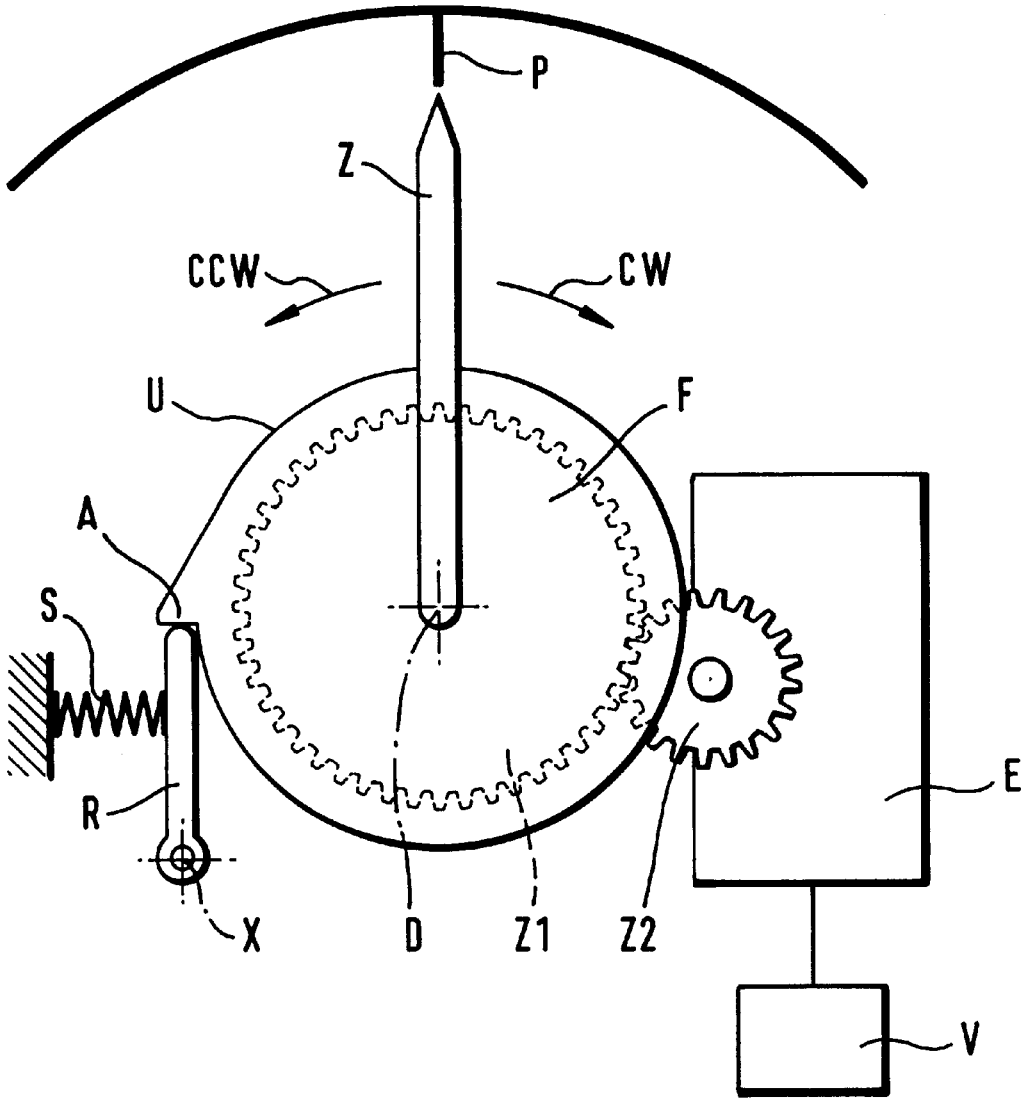
FIG. 1 shows the schematic diagram of a first exemplary embodiment of the invention.

FIG. 1 shows a hand Z which is mounted such that it can be rotated about an axis of rotation D. The hand Z is connected in rotationally fixed manner to a shaped body F, of which the top circumference U, with the exception of a convex portion with a stop A, is of circular configuration.

Formed in the bottom region of the shaped body F is a gear wheel Z1 which interacts with a gear wheel Z2 of an electric drive E. A detecting device V can monitor, for example, the currents of the electric drive E. A locking bar R is mounted such that it can be pivoted about an axis x and is forced against the top circumference U of the shaped body F by a spring S. The hand Z can be rotated in an unlimited manner in the clockwise direction CW by the electric drive E since, by virtue of the configuration of the convex portion of the top circumference U, the locking bar R is forced in the direction counter to the axis of rotation D, thus overcomes the convex portion before the stop A and then is forced back, by the spring S, into the position illustrated in FIG. 1 in the direction of the axis of rotation D. Upon rotation of the hand Z from any desired position counter to the clockwise direction CCW, the locking bar R cannot overcome the stop A and the hand Z remains in a reference position P. This inability to rotate further is sensed by means of the detecting device V by virtue of electrical values of the electric drive E being monitored.

Figure 2:
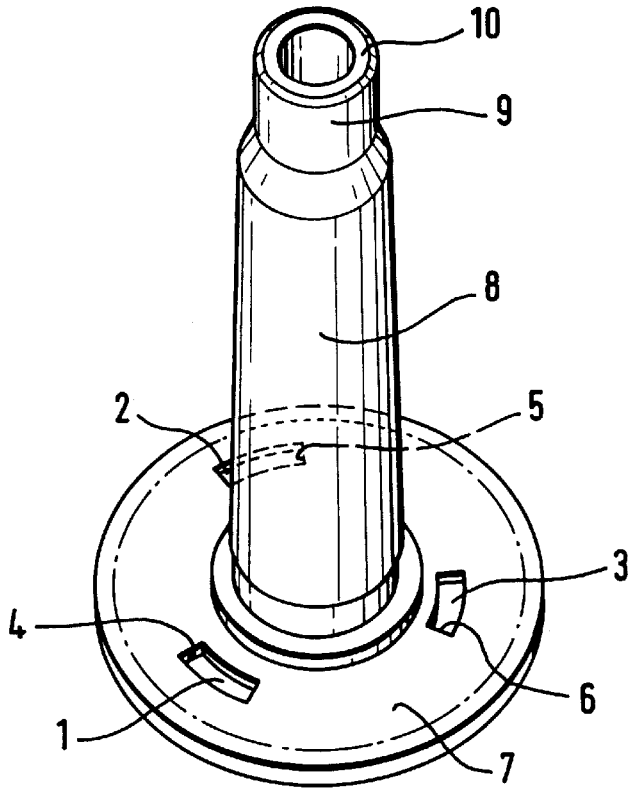
FIG. 2 shows a second disk of a preferred second exemplary embodiment, the second disk being formed integrally with a hand stem.

In FIG. 2, three radially curved grooves 1, 2, 3, of which the border forms a stop 4, 5, 6 in each case, are arranged in a second disk 7. Arranged on the inner border of the second disk 7 is a hand stem 8 which tapers to a hand mount 9 on which it is possible to install a hand (not illustrated) which, upon movement in a second direction, is to assume a reference position. The hand mount 9 has a tapering top border 10 which facilitates the installation of the abovementioned hand.

Figure 3:
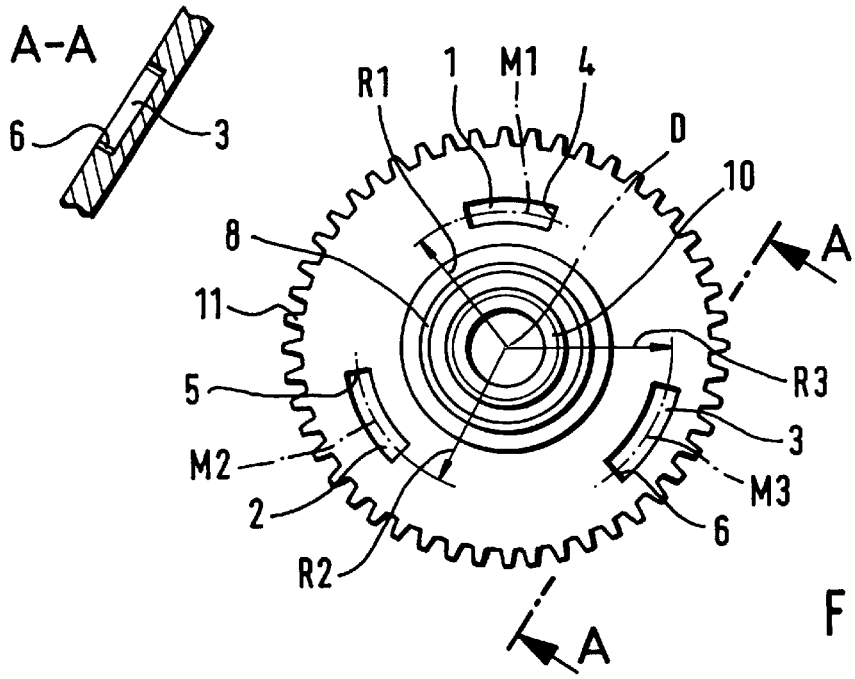
FIG. 3 shows the plan view of the components from FIG. 2.

In FIG. 3, it is also possible to see that the center lines M1, M2, M3 of the radially curved groves 1, 2, 3 are at different distances R1, R2, R3 from the axis of rotation D. The grooves 1, 2, 3 may have a uniform depth, as is shown in the section AA, or else may become shallower as the distance from the stops 4, 5, 6 increases, until, at their other ends, they reach the height of the plane defined by the surface of the second disk 7.

Formed on the circumference of the second disk 7 is a toothed profile 11 which connects the hand stem 8 to an electric drive in a force-fitting manner via a gear mechanism (not otherwise illustrated).

Figure 4:
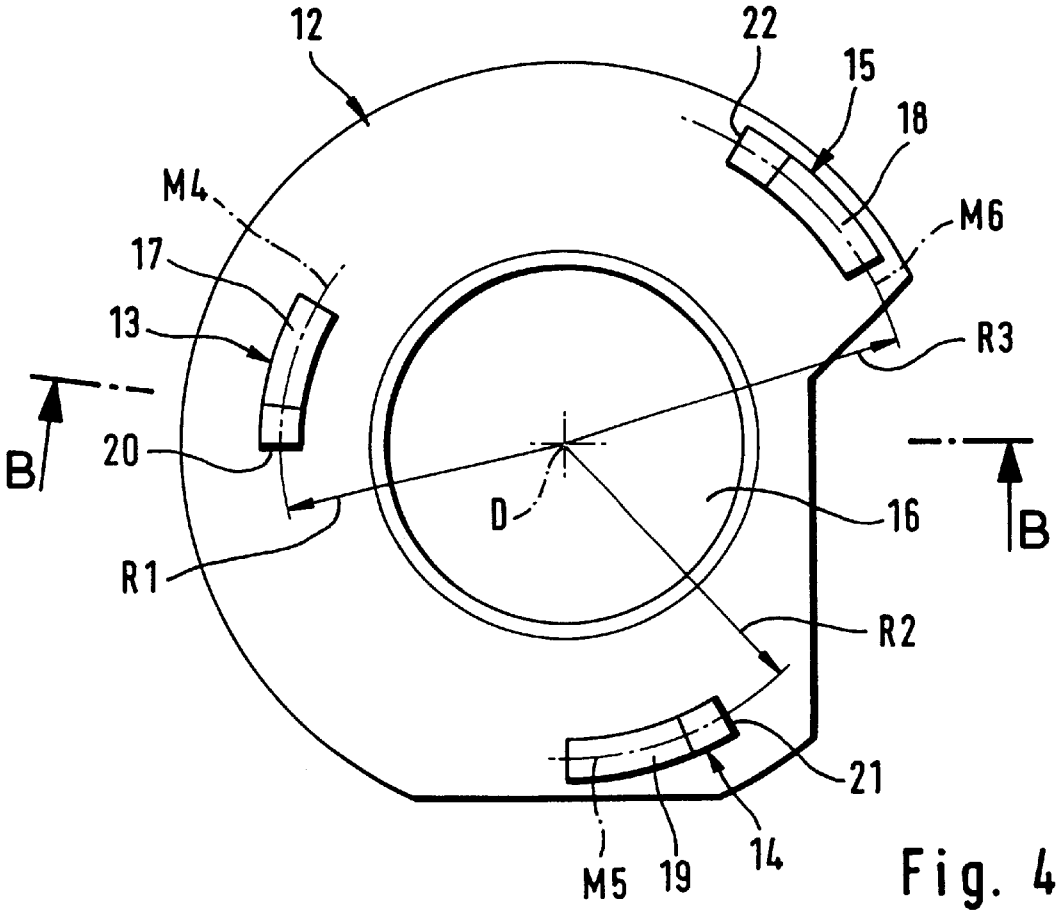
FIG. 4 shows the plan view of an exemplary embodiment of a first disk of the second exemplary embodiment.

FIG. 4 shows the plan view of a first disk 12 with segments 13, 14, 15 and a hand-stem opening 16. The center lines M4, M5, M6 of the segments 13, 14, 15 are each likewise at the same distance as R1, R2, R3 from the axis of rotation D as the radially curved grooves 1, 2, 3. The segments 13, 14, 15 each have a slanting surface 17, 18, 19 and end surfaces 20, 21, 22.

Figure 5:
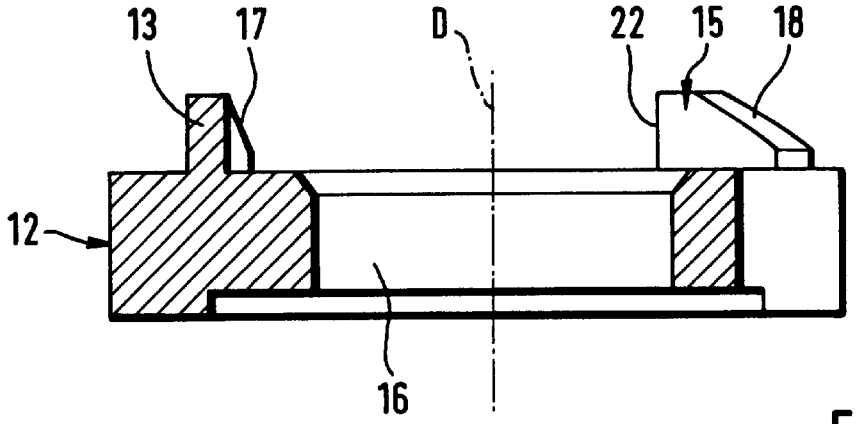
FIG. 5 shows the section B—B from FIG. 4.

The construction of the slanting surfaces 17, 18 can better be seen in FIG. 5. The slanting surface 19 which cannot be seen in FIG. 5 is of corresponding construction.

The functioning of the abovedescribed component is described hereinbelow:

The hand stem 8 is guided from above (as seen from the viewing direction of FIGS. 4 and 5) through the hand-stem opening 16 of the first disk 12 until the respective top side of the second disk 7 and of the first disk 12, said top sides being shown in FIGS. 3 and 4, rest one upon the other. The two disks 7, 12 are forced one onto the other by one or more components (not illustrated), for example a spring element: this means that hand stem 8 with the second disk 7, in plan view (as shown in FIGS. 2 and 3), can be rotated in a clockwise direction with respect to the first disk in an unlimited manner: the segments 13, 14, 15 each penetrate into the curved grooves 1, 2, 3 when they have reached the position thereof and, upon further rotation of the second disk 7, are forced out of the grooves again by the slanting surfaces 17, 18, 19. Upon rotation counter to the clockwise direction, the hand stem 8 with the second disk 7 can be rotated with respect to the first disk 12 until such time as the segments 13, 14, 15 penetrate gradually into the radially curved grooves 1, 2, 3 by way of the slanting surfaces 17, 18, 19 and the end surfaces 20, 21, 22 each strike against the stops 4, 5, 6. Since in each case one radially curved groove 1, 2, 3 and in each case one segment 13, 14, 15 have the same distance R1, R2, R3 between their respective center line M1, M2, M3 and the axis of rotation D, it is only possible for the segment 13 to penetrate into the groove 1, for the segment 14 to penetrate into the groove 2 and for the segment 15 to penetrate into the groove 3: thus, upon rotation counter to the clockwise direction, the hand stem is stopped in precisely one position, which is then used as the reference position.

Figure 6:
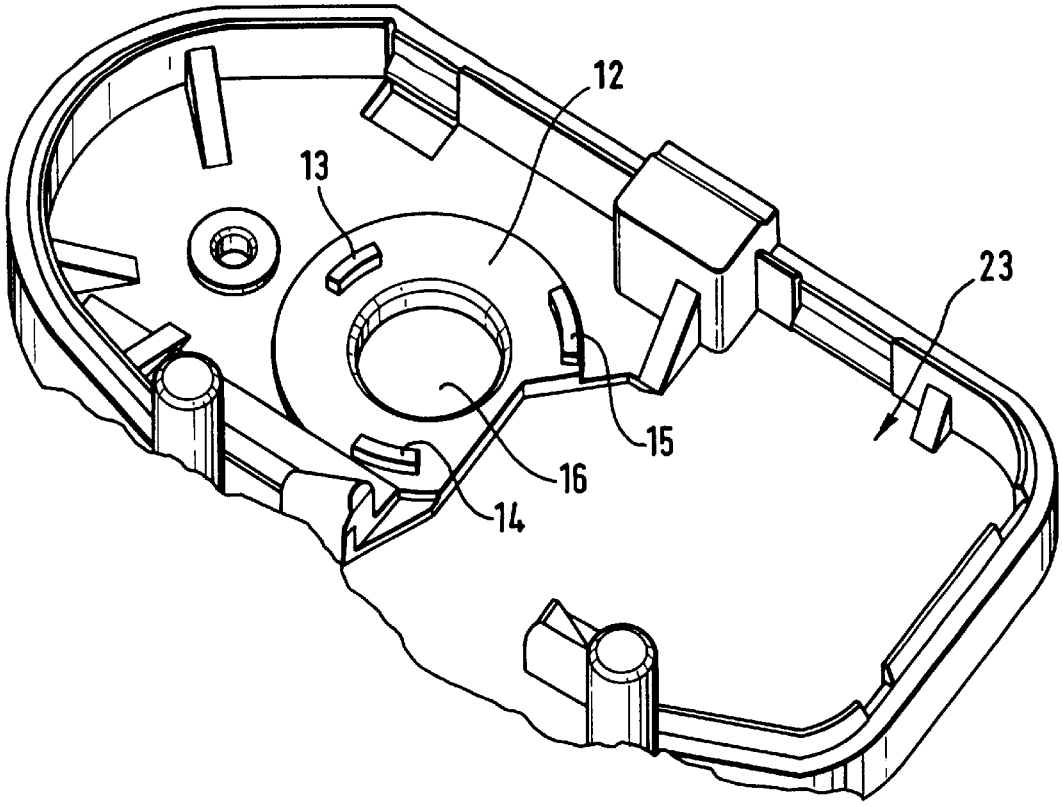
FIG. 6 shows a view of part of the housing in which the first disk from FIGS. 4 and 5 is integrated.

FIG. 6 shows a possible configuration of the first disks as part of a housing 23. The housing 23 is produced in one piece with the first disk, for example, as an injection molding. This dispenses with additional installation of the first disk 12.

Figure 7:
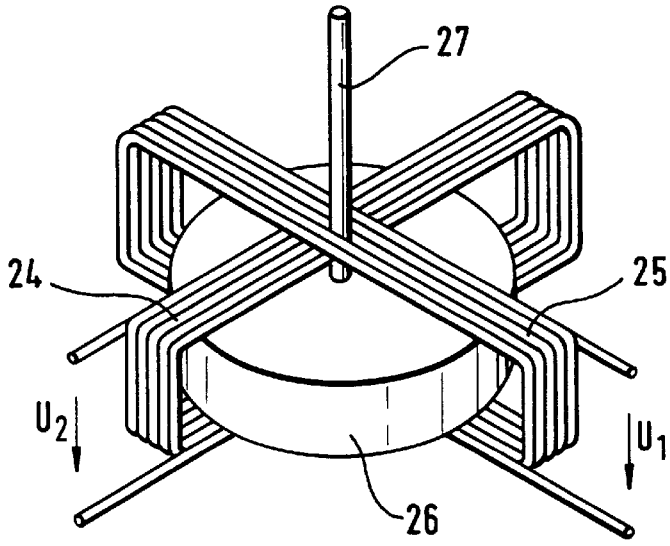
FIG. 7 shows a view of a stepping motor as the drive element.

FIG. 7 shows a possible configuration of the electric drive. A stepping motor has 2 coils 24, 25, a permanent-magnet rotor 26, which is magnetized diametrically, and a rotor shaft 27. The rotor shaft 27 is connected to the second disk 7 and the hand stem 8 via a gear mechanism (not illustrated). In order to rotate the hand stem 8 counter to the clockwise direction, one of the coils 24, 25 is supplied with power alternately in each case, with the result that the rotor 26 rotates further by in each case one quarter-rotation. The rotation of the rotor 26 induces, in the coil which is not supplied with power in each case, a voltage which can be evaluated by a monitoring unit (not illustrated). When the hand stem has reached its reference position (P in FIG. 1) and cannot rotate any further counter to the clockwise direction, rotation of the rotor 26 is also prevented, with the result that there is no voltage induced by the rotor 26 in the coil which is not supplied with power in each case. It is thus possible to establish, by the detecting device (for example V in FIG. 1), that the hand has reached its reference position.

We claim:

1. A display having at least one hand which is drivable by an electric drive to execute rotations of more than 360° in a first direction, wherein the at least one hand can be rotated in a second direction which is opposite to the first direction, wherein the at least one hand can be rotated in the second direction only up to a certain position and, in this position, takes a reference position, wherein there is a detecting device which detects an inability of the at least one hand to rotate further in the second direction, and the display further comprises at least one stop device extending from a stationary part of the display to a movable part of the display for stopping rotation of the at least one hand in the second direction of rotation at the certain position.

2. The display as claimed in claim 1, wherein the at least one stop device prevents the at least one hand from rotating beyond the certain position in the second direction.

3. A display having at least one hand which is drivable by an electric drive to execute rotations of more than 360° in a first direction, wherein the at least one hand can be rotated in a second direction which is opposite to the first direction, wherein the at least one hand can be rotated in the second direction only up to a certain position and, in this position, takes a reference position, wherein there is a detecting device which detects an inability of the at least one hand to rotate further in the second direction, the display further comprises a stop device which prevents the at least one hand from rotating beyond the certain position in the second direction, and further comprises at least one locking bar which is mounted in such a manner and interacts with at least one stop only upon rotation of the at least one hand in the second direction and thus prevents the rotation of the at least one hand in the second direction.

4. The display as claimed in claim 2, wherein the at least one stop device is a first stop device, the display further comprising a second stop device having one or more segments (13, 14, 15) which interact respectively with one or more stops (4, 5, 6) of the second stop device, wherein the segments (13, 14, 15) and/or the stops (4, 5, 6) are mounted for rotation about an axis (D) and the segments (13, 14, 15) have slanting surfaces (17, 18, 19) which, upon rotation in the first direction (CW), cause an axial displacement of the segments (13, 14, 15) or of the stops (4, 5, 6) such that the rotation can be continued in an unlimited manner, and wherein, upon rotation in the second direction (CCW), the one or more segments (13, 14, 15) strike respectively against the one or more stops (4, 5, 6) in a certain position (P) and thus prevent further rotation in the second direction (CCW), and wherein a second of said at least one hand is connected in a rotationally fixed manner to the one or more segments (13, 14, 15) or to the one or more stops (4, 5, 6).

5. The display as claimed in claim 4, wherein a plurality of segments (13, 14, 15) are arranged at different distances (R1, R2, R3) from an axis of rotation (D) of the hand (Z) and interact with corresponding stops (4, 5, 6).

6. The display as claimed in claim 5, wherein the segments (13, 14, 15) are arranged around the axis of rotation (D).

7. The display as claimed in claim 6, wherein said segments (13, 14, 15) are arranged on a first disk (12).

8. The display as claimed in claim 6, wherein the stops (4, 5, 6) are arranged in radially curved grooves (1, 2, 3) of a second disk (7).

9. The display as claimed in claim 8, wherein the segments (13, 14, 15) are arranged on a first disk (12), one of the two disks (7, 12) is connected in a rotationally fixed manner to the second of said at least one hand, and wherein one of the two disks (7, 12) is axially displaceable.

10. The display as claimed in claim 7, wherein one of the disks (7, 12) is configured as part of a housing of the drive or of the display.

11. The display as claimed in claim 1, wherein power consumption of an electric drive (E) is monitorable by the detecting device (V).

12. The display as claimed in claim 1, further comprising an electric drive (E) which comprises a stepping motor with a permanent-magnet rotor (26) and a plurality of coils (24, 25), rotor (26) of the motor being drivable by an alternating supply of power to the coils (24, 25).

13. The display as claimed in claim 12, wherein voltage which is induced, by rotation of the permanent-magnet rotor (26), is measurable in the coil or coils supplied with power (24, 25).

14. A display having a first hand and a second hand, which are drivable by an electric drive to execute rotations of more than 360° in a first direction, wherein each of the hands can be rotated in a second direction which is opposite to the first direction, wherein either hand can be rotated in the second direction only up to a certain position and, in this position, takes a reference position, wherein there is a detecting device which detects an inability of the first hand or the second hand to rotate further in the second direction, the display further comprises a first stop device and a second stop device which prevents respectively the first hand and the second hand from rotating beyond the certain position in the second direction, the first stop device comprising a spring loaded bar directed against a rotatable structure of the first hand, and the second stop device comprising the combination of a perforated disk and a wedge carrying element rotatable relative to each other wherein entry of a wedge into a perforation in the second direction of rotation stops said second hand from further rotation in the second direction, one of said perforated disk and said wedge carrying element being fixed to a rotatable structure of said second hand.

* * * * *